US009644451B2

(12) United States Patent
Vlielander et al.

(10) Patent No.: US 9,644,451 B2
(45) Date of Patent: May 9, 2017

(54) DOWNHOLE VALVE FOR FLUID ENERGIZED PACKERS

(71) Applicant: TAM International, Inc., Houston, TX (US)

(72) Inventors: Ray Vlielander, Estevan (CA); Dennis Gonas, Beinfait (CA); Mark Wyatt, Magnolia, TX (US); Ross Phillips, Baytown, TX (US)

(73) Assignee: TAM INTERNATIONAL, INC., Houston, TX (US)

( * ) Notice: Subject to any disclaimer, the term of this patent is extended or adjusted under 35 U.S.C. 154(b) by 522 days.

(21) Appl. No.: 14/310,819

(22) Filed: Jun. 20, 2014

(65) Prior Publication Data

US 2014/0374120 A1 Dec. 25, 2014

Related U.S. Application Data

(60) Provisional application No. 61/837,876, filed on Jun. 21, 2013.

(51) Int. Cl.

| | |
|---|---|
| ***E21B 34/12*** | (2006.01) |
| ***E21B 23/06*** | (2006.01) |
| ***E21B 33/127*** | (2006.01) |
| ***E21B 43/26*** | (2006.01) |
| ***E21B 33/124*** | (2006.01) |
| *E21B 34/00* | (2006.01) |

(52) U.S. Cl.

CPC ..... *E21B 34/12* (2013.01); *E21B 23/06* (2013.01); *E21B 33/127* (2013.01); *E21B 33/1243* (2013.01); *E21B 43/26* (2013.01); *E21B 2034/002* (2013.01)

(58) Field of Classification Search

CPC ..... E21B 34/12; E21B 34/125; E21B 33/127

See application file for complete search history.

(56) References Cited

U.S. PATENT DOCUMENTS 2,210,245 A * 8/1940 Kimmel ..... E21B 27/02 166/146

2,227,731 A * 1/1941 Lynes ..... E21B 49/081 166/147

(Continued)

OTHER PUBLICATIONS

International Search Report and Written Opinion issued in International Application No. PCT/US2014/043456, dated Oct. 23, 2014 (10 pages).

(Continued)

*Primary Examiner* — Blake Michener

(74) *Attorney, Agent, or Firm* — Adolph Locklar

(57) ABSTRACT

A downhole valve for fluid energized packers includes a valve sub and a packer. The valve sub further includes a control tube and a rotatable ball, the control tube having at least one closable aperture fluidly coupled to the packer when open, and the rotatable ball rotatable about an axle having at least one flow path closable by a rotation of the ball. The rotatable ball rotates about an axle coupled to a shift sleeve coupled to the lower end of the control tube. The rotatable ball includes a rotation pin extending from its outer surface and a rotation pin sleeve is adapted to rotate the ball in response to a movement of the ball toward or away from the rotation pin sleeve.

17 Claims, 14 Drawing Sheets

(56) References Cited

U.S. PATENT DOCUMENTS

| | | | | | |
|---|---|---|---|---|---|
| 2,611,437 | A * | 9/1952 | Lynes | E21B 33/127 | 277/334 |
| 2,851,109 | A * | 9/1958 | Spearow | E21B 33/124 | 166/177.5 |
| 3,007,669 | A * | 11/1961 | Fredd | E21B 34/10 | 137/505.47 |
| 3,334,691 | A | 8/1967 | Parker | | |
| 3,347,318 | A * | 10/1967 | Barrington | E21B 34/12 | 166/150 |
| 3,360,235 | A * | 12/1967 | Myers | E21B 34/12 | 251/341 |
| 3,386,701 | A * | 6/1968 | Potts | E21B 34/12 | 166/330 |
| 3,414,059 | A * | 12/1968 | Nutter | E21B 23/00 | 166/128 |
| 3,901,333 | A * | 8/1975 | Mori | E21B 21/103 | 166/334.3 |
| 4,212,355 | A | 7/1980 | Reardon | | |
| 4,273,190 | A * | 6/1981 | Baker | E21B 23/006 | 166/278 |
| 4,293,038 | A * | 10/1981 | Evans | E21B 23/006 | 137/629 |
| 4,627,488 | A | 12/1986 | Szarka | | |
| 4,712,613 | A | 12/1987 | Nieuwstad | | |
| 5,143,015 | A | 9/1992 | Lubitz et al. | | |
| 5,782,306 | A * | 7/1998 | Serafin | E21B 33/1243 | 166/187 |
| 5,791,414 | A | 8/1998 | Skinner et al. | | |
| 6,125,930 | A | 10/2000 | Moyes | | |
| 6,269,878 | B1 * | 8/2001 | Wyatt | E21B 23/06 | 166/142 |
| 6,578,638 | B2 * | 6/2003 | Guillory | E21B 23/06 | 166/123 |
| 6,883,610 | B2 * | 4/2005 | Depiak | E21B 43/26 | 166/177.5 |
| 2002/0036087 | A1 * | 3/2002 | Bixenman | E21B 34/12 | 166/278 |
| 2003/0141055 | A1 * | 7/2003 | Paluch | E21B 7/068 | 166/254.2 |
| 2004/0108109 | A1 | 6/2004 | Allamon et al. | | |
| 2010/0276153 | A1 * | 11/2010 | Gette | E21B 33/04 | 166/351 |
| 2014/0374119 | A1 * | 12/2014 | Dewars | E21B 33/00 | 166/373 |

OTHER PUBLICATIONS

International Search Report and Written Opinion Issued in PCT Patent Application No. PCT/US2014/043456 dated Oct. 23, 2014 (11 pages).

* cited by examiner

DOWNHOLE VALVE FOR FLUID ENERGIZED PACKERS

CROSS-REFERENCE TO RELATED APPLICATIONS

This application is a non-provisional application which claims priority from U.S. provisional application No. 61/837,876, filed Jun. 21, 2013.

TECHNICAL FIELD/FIELD OF THE DISCLOSURE

The present disclosure relates generally to well isolation devices, and specifically to valves for fluid actuated well isolation devices.

BACKGROUND OF THE DISCLOSURE

Fluid-energized, or inflatable, packers are isolation devices used in a wellbore to seal the inside of the wellbore or a downhole tubular. Inflatable packers generally rely on elastomeric bladders to expand and form an annular seal when inflated by fluid pressure. Typically, inflatable packers are controlled by packer valves. Various configurations of packer valves have been devised, including two-valve controlled packers in which one valve is used to inflate the packer and the other is used to regulate the maximum pressure applied to the packer. In a typical configuration, packer valves are controlled by sending control balls through a tool string to actuate or release one or more of the valves.

SUMMARY

The present disclosure provides for a downhole tool on a tool string having a tool string bore positionable in a wellbore having a wellbore axis. The downhole tool may include a first packer sub coupled to the tool string. The packer sub has a first inflatable element and a first packer inflation port. A valve sub is coupled to the tool string. The valve sub may include a valve sub housing, the valve sub housing being generally tubular having at least one packer supply port in fluid communication with the packer inflation port. The valve sub further includes a control tube, the control tube being generally tubular and aligned with the valve sub housing and having an upper and lower end, the upper end coupled to the tool string, and the lower end positioned within the bore of the valve sub housing. The control tube has a bore and at least one aperture through its side wall, the control tube having an open position in which the aperture provides fluid communication between the bore of the control tube and the packer supply port, and a closed position in which the apertures are covered by the inner wall of the valve sub housing and the bore of the control tube, the control tube bore being in fluid communication with the tool string bore. The valve sub further includes a shift sleeve coupled to the lower end of the control tube having a hole adapted to accept an axle pin. The valve sub also includes a rotatable ball adapted to rotate about the axle pin, the rotatable ball having at least one flow path through its body. The rotatable ball has an open position and a closed position selected by the upward or downward movement of the tool string, the open and closed positions of the rotatable ball being in opposition to the open and closed position of the control tube, thereby allowing or preventing fluid flow through the at least one flow path from the tool string bore and the bore of the control tube. The rotatable ball has a rotation pin extending from its outer surface. The valve sub also includes a rotation pin sleeve coupled to the rotation pin adapted to rotate the ball from the closed position to the open position in response to a movement of the ball toward or away from the rotation pin sleeve.

The present disclosure also provides for a method. The method may include providing a first packer sub coupled to the tool string, the packer sub having a first inflatable element and a first packer inflation port. The method also includes providing a valve sub coupled to the tool string. The valve sub may include a valve sub housing, the valve sub housing being generally tubular having at least one packer supply port in fluid communication with the packer inflation port. The valve sub further includes a control tube, the control tube being generally tubular and aligned with the valve sub housing and having an upper and lower end, the upper end coupled to the tool string, and the lower end positioned within the bore of the valve sub housing, the control tube having a bore and at least one aperture through its side wall. The control tube has an open position in which the aperture provides fluid communication between the bore of the control tube and the packer supply port, and a closed position in which the apertures are covered by the inner wall of the valve sub housing and the bore of the control tube, the position selected by an upward or downward movement of the tool string. The control tube bore is in fluid communication with the tool string bore. The valve sub also includes a shift sleeve coupled to the lower end of the control tube having a hole adapted to accept an axle pin and a rotatable ball adapted to rotate about the axle pin. The rotatable ball has at least one flow path through its body and the rotatable ball has an open position and a closed position selected by the upward or downward movement of the tool string, the open and closed positions of the rotatable ball being in opposition to the open and closed position of the control tube, thereby allowing or preventing fluid flow through the at least one flow path from the tool string bore and the bore of the control tube. The rotatable ball has a rotation pin extending from its outer surface and a rotation pin sleeve coupled to the rotation pin adapted to transition the rotatable ball from the closed position to the open position in response to a movement of the rotatable ball toward or away from the rotation pin sleeve. The method may also include running the downhole tool to a desired position and filling the first inflatable element. The method also includes transitioning the control tube into the closed position and transitioning the rotatable ball into the open position and pumping fluid through the tool bore. In addition, the method includes transitioning the control tube into the open position, allowing fluid from the first inflatable elements to drain and transitioning the rotatable ball into the closed position.

The present disclosure also provides for a valve assembly for use in a downhole tool as part of a tool string. The valve assembly may include a housing, the housing being generally tubular having at least one output port. The valve assembly may also include a control tube, the control tube being generally tubular and aligned with the housing and having an upper and lower end, the upper end coupled to the tool string, and the lower end positioned within the bore of the housing. The control tube has a bore and at least one aperture through its side wall. The control tube has an open position in which the aperture provides fluid communication between the bore of the control tube and the output port, and a closed position in which the apertures are covered by the inner wall of the housing, the open and closed positions of the control tube selected by the upward or downward movement of the tool string the control tube bore being in fluid communication with the tool string bore. The valve assembly further includes a shift sleeve coupled to the lower end of the control tube having a hole adapted to accept an axle pin and a rotatable ball adapted to rotate about the axle pin. The rotatable ball has at least one flow path through its body. The rotatable ball has an open position and a closed position selected by the upward or downward movement of the tool string, the open and closed positions of the rotatable ball being in opposition to the open and closed position of the control tube, thereby allowing or preventing fluid flow through the at least one flow path from the tool string bore and the bore of the control tube, the rotatable ball having a rotation pin extending from its outer surface. The valve assembly further includes a rotation pin sleeve coupled to the rotation pin adapted to rotate the ball from the closed position to the open position in response to a movement of the ball toward or away from the rotation pin sleeve.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1A:
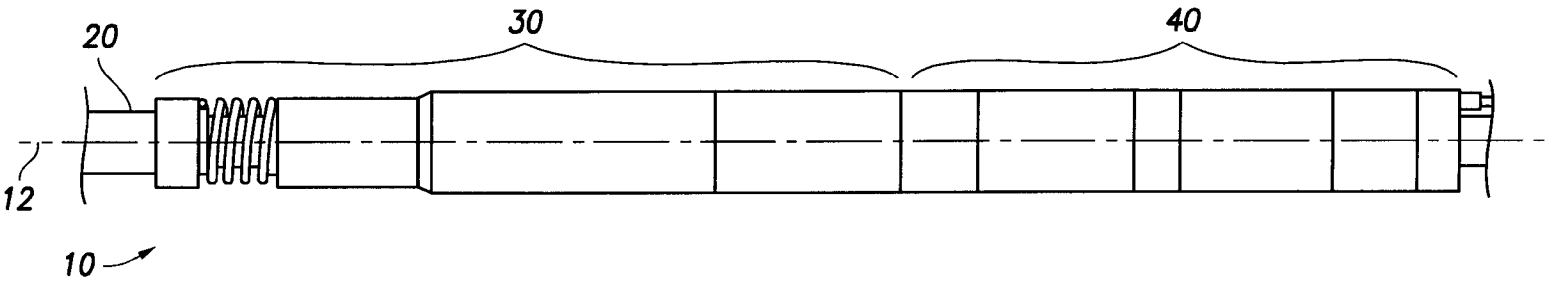
FIGS. 1A-1C are partial elevation views of a downhole tool consistent with at least one embodiment of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

Figure 1B:
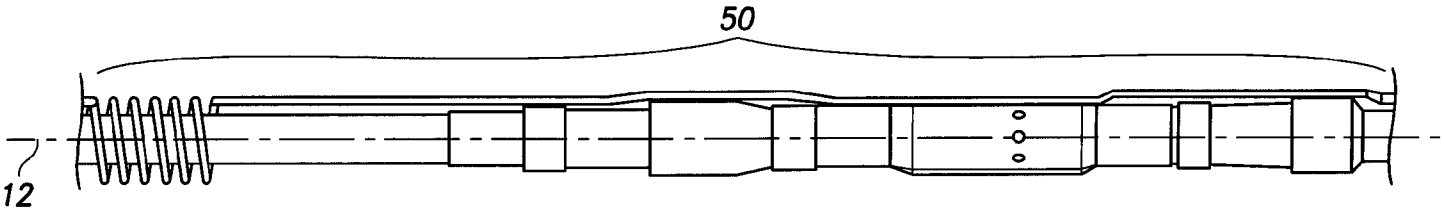
Figure 1C:
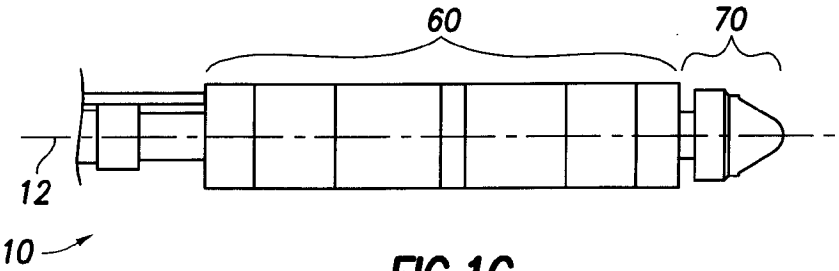

FIGS. 1A-1C illustrate one embodiment of downhole fracing tool 10 for positioning downhole in a well to seal with either the interior surface of a wellbore or an interior surface of a downhole tubular (not shown). During operation, central axis 12 of downhole fracing tool 10 as shown in FIGS. 1A-1C may be generally aligned with the central bore of the wellbore or the central bore of the tubular in the well when downhole fracing tool 10 is lowered to the desired depth in the well. Central axis 12 may also be generally aligned with the central bore of the wellbore when downhole fracing tool 10 performs its sealing function. Throughout this disclosure, the terms "upstream", "upper", "upward", and "above" are used to refer to a position proximal to or a direction towards the surface end of the wellbore. Likewise, the terms "downstream", "lower", "downward", and "below" are used to refer to a position more distal to or a direction away from the surface end of the wellbore. Furthermore, downhole tool 10 is described with regard to a fracing configuration and operation, and one having ordinary skill in the art will understand that downhole tool 10 may be used in other configurations—including but not limited to a single-packer configuration—and for other operations requiring the selective inflation of a downhole packer.

In the embodiment depicted in FIGS. 1-9, downhole fracing tool 10 is configured as a zonal isolation tool for the selective fracing of a section of a well, also known as a "straddle packer" system. Downhole fracing tool 10 may include string connection sub 20, valve sub 30, upper packer sub 40, fracing sub 50, lower packer sub 60, and nose sub 70.

Figure 2:
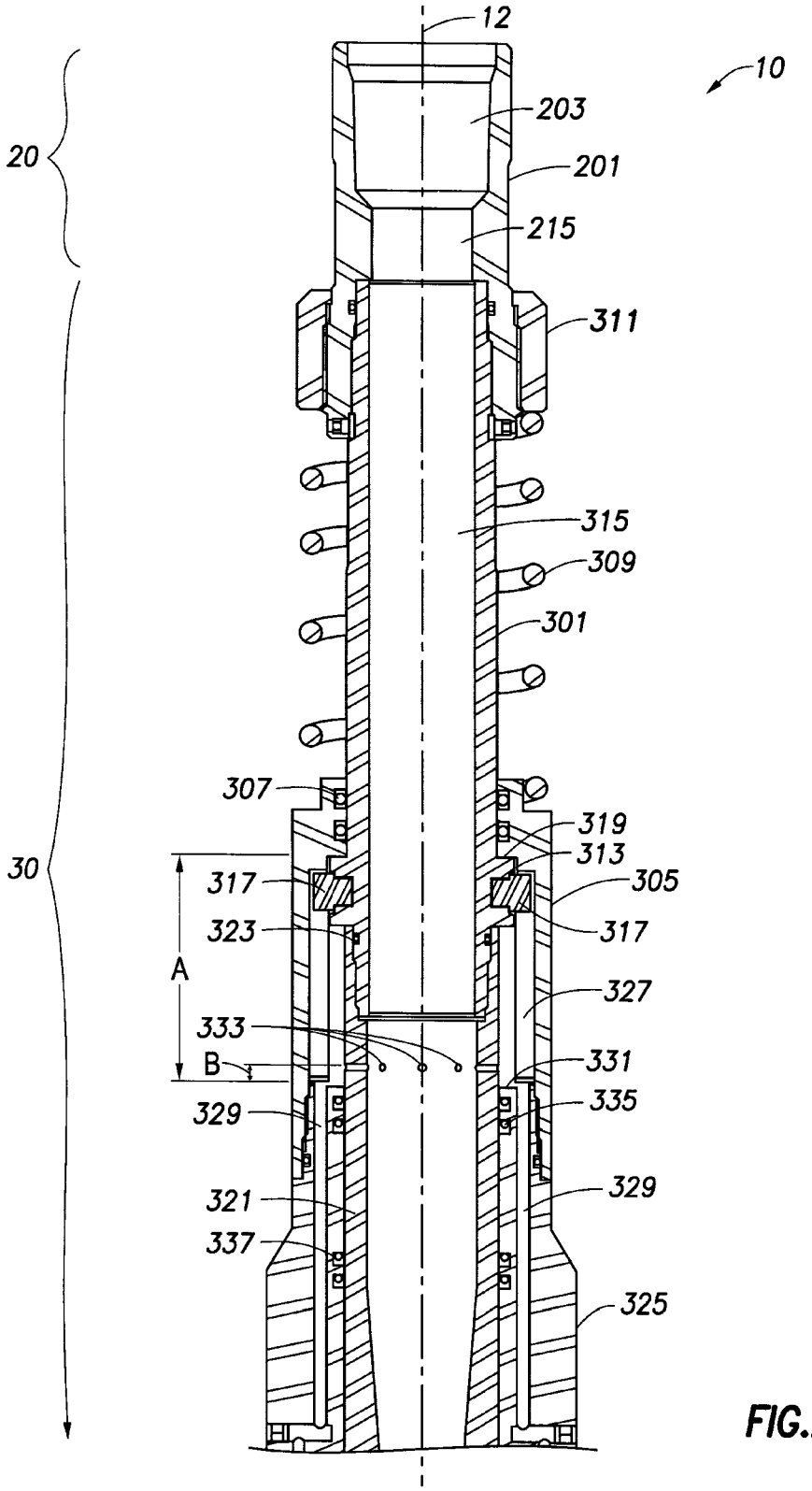
FIG. 2 is a partial cross-section of the tool of FIGS. 1A-1C depicting a "run-in configuration" consistent with at least one embodiment of the present disclosure.

String connection sub 20, as depicted in FIG. 2, may include upstream connection housing 201. Upstream connection housing 201 is generally cylindrical and may include upstream receptacle 203 configured to couple downhole fracing tool 10 to the rest of a work string (not shown) for insertion down a wellbore. Upstream receptacle 203 may be a threaded joint or any other coupling suitable for downhole string connections. Upstream connection housing 201 is configured to couple to an upper end of control tube 301 of valve sub 30 by, for example, a threaded connection, and provide a sealed connection between string connection sub bore 215 and valve sub bore 315. Seal 303 as illustrated assists in this seal.

Control tube 301, as illustrated, is a generally straight-walled cylindrical tube which extends axially downward from string connection sub 20. Lower end of control tube 301 fits into the bore of upper control housing 305. The bore of upper control housing 305 is generally cylindrical, and at its upper end has a diameter selected to allow a clearance or sliding fit with the outer wall of control tube 301. Outer wall of control tube 301 is fluidly sealed to the interior of upper control housing 305 by at least one seal 307, and is permitted to slide into and out of upper control housing 305 by upward or downward loading of the work string. In some embodiments, spring 309 may be included and configured to apply compressive force between spring nut 311 and the upper wall of upper control housing 305. Spring nut 311 is coupled to the outer wall of upstream connection housing 201 by, for example, a threaded connection. Spring 309 is illustrated as a coil spring axially disposed around control tube 301.

Control tube 301 may include, proximal to its lower end, at least one means for preventing removal from upper control housing 305. Likewise, upper control housing 305 at its upper end may include a matching means. FIG. 2 illustrates control tube 301 having at least one flanged groove 313 configured to accept at least one J-pin 317. As illustrated, as control tube 301 is pulled upward from any upward work string loading or force from spring 309, flanged groove 313 abuts against at least one upper interior flange 319 of upper control housing 305. J pin 317 is positioned within an internal groove that is part of upper control housing 305. J pin 317 allows any torque applied to the work string to be transmitted through the upper control housing 305 and subsequently through the entire valve sub 30. Upper interior flange 319 of upper control housing 305 is formed by an increase in diameter of the inner wall of upper control housing 305. One of ordinary skill in the art will understand that this is only an exemplary configuration for preventing removal of control tube 301 from upper control housing 305, and other technically equivalent means may be employed without deviating from the scope of this disclosure.

Control tube 301 is coupled at its lower end to control tube extension 321 forming a fluidly sealed connection between the interior bore of control tube 301 and the interior bore of control tube extension 321, here depicted as including seal 323. Control tube extension 321 is a generally cylindrical, straight-walled tube extending downward along central axis 12, the bore of which fluidly connecting to and forming a continuation of valve sub bore 315.

Figure 10:
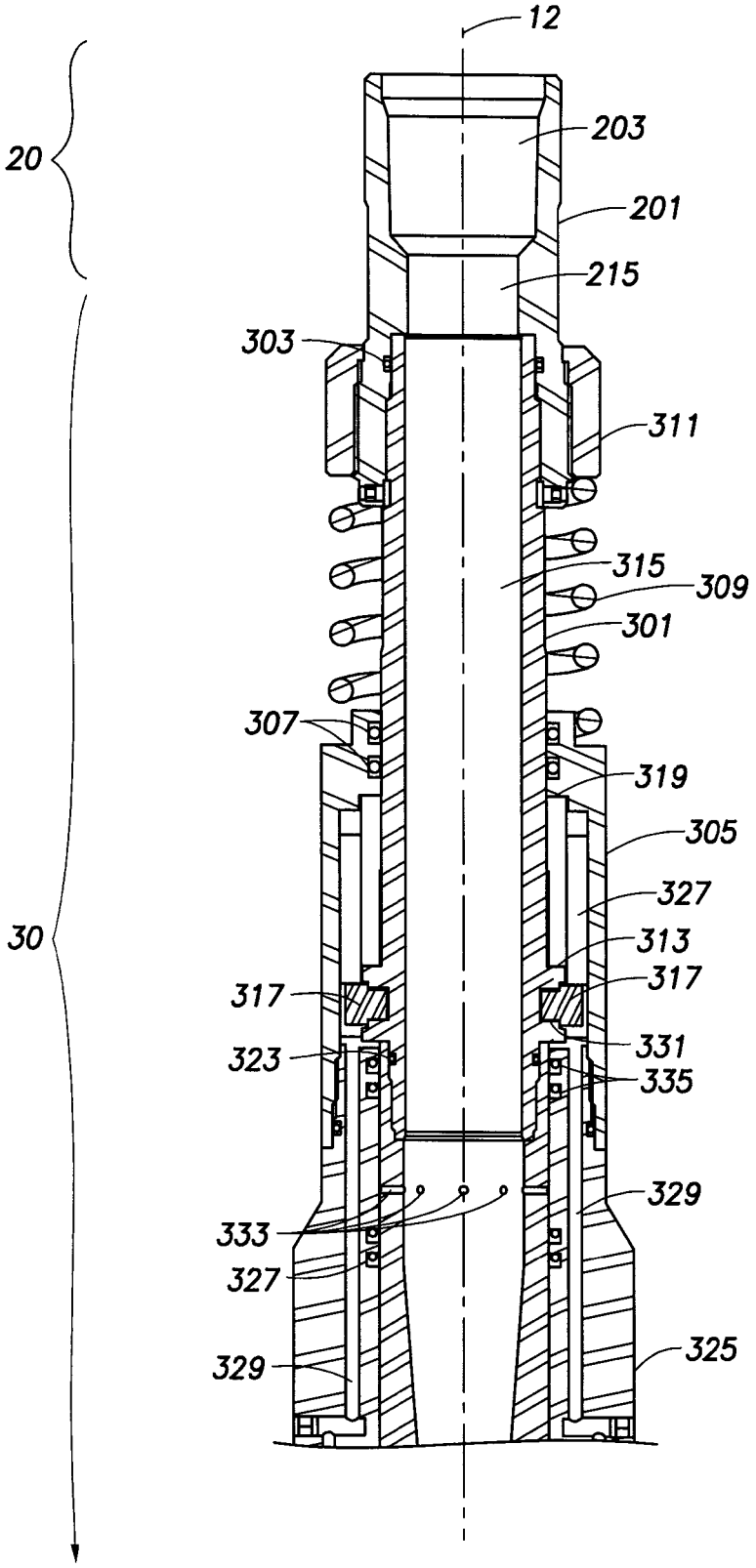
FIG. 10 is a partial cross section of the tool of FIGS. 1A-1C depicting an "actuated configuration" consistent with at least one embodiment of the present disclosure.
Figure 11:
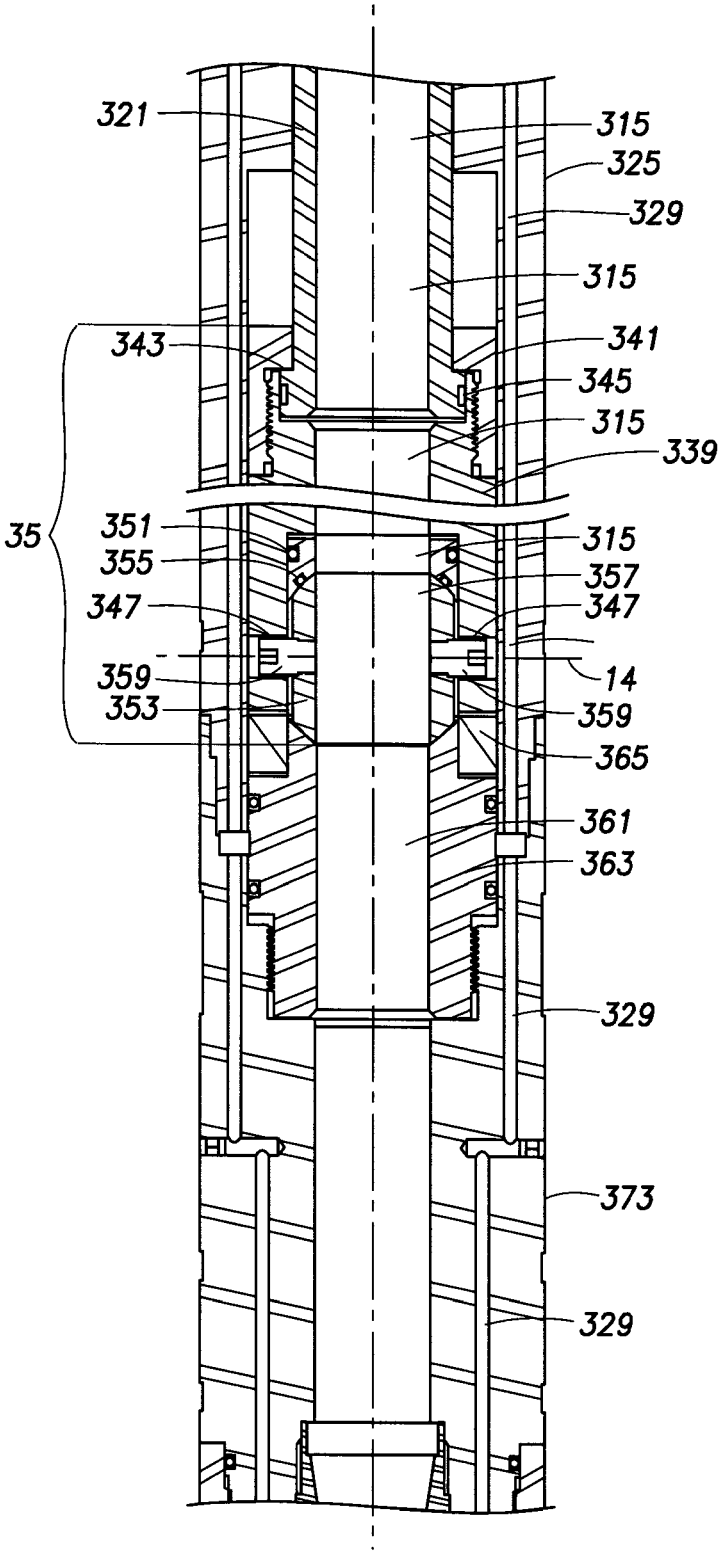
FIG. 11 is a continuation of the partial cross-section of FIG. 10 depicting an "actuated configuration" consistent with at least one embodiment of the present disclosure.

Upper control housing 305 is coupled at its lower end to the upper end of lower control housing 325 forming a fluidly sealed connection between annular space 327 and at least one packer inflation port 329 formed in the body of lower control housing 325. Annular space 327 is defined as the cavity formed between the outer surface of control tube 301 and/or control tube extension 321 and the inner surface of upper control housing 305. Packer inflation port 329 continues through the rest of valve sub 30 to packer sub 40. Lower control housing 325 is a generally cylindrical tube having a smaller inner diameter than the inner diameter of the lower end of upper control housing 305, forming a lower interior flange 331. Lower interior flange 331 is positioned as a means to prevent over-insertion of control tube 301. As illustrated in FIG. 10, control tube 301 is forced downward into an "actuated position" by downward work string loading. Flanged groove 313 and J-pin 317 abut against upper surface 331, preventing any further movement. One of ordinary skill in the art will understand that this is only an exemplary configuration for preventing overinsertion, and other technically equivalent means may be employed without deviating from the scope of this disclosure. In this example, the axial distance between upper interior flange 319 and lower interior flange 331 defines stroke length A, the distance control tube 301 is allowed to traverse between the run-in position (depicted in FIGS. 2, 3) and the actuated position (FIGS. 10, 11).

Referring to FIG. 2, the inner diameter of lower control housing 325 is selected to form a close clearance fit with the outer wall of control tube extension 321. Control tube extension 321 is able to traverse axially within lower control housing 325 as control tube 301 is moved.

Proximal to the upper end of control tube extension 321, a series of apertures 333 are positioned through the wall of control tube extension 321. Apertures 333 connect the bore of control tube extension 321 to the surrounding area. When control tube extension 321 is in the run-in position, as depicted in FIG. 2, apertures 333 form a fluid connection between the bore of control tube 321 and annular space 327, thereby allowing fluid a continuous connection between the bore of the work string and packer inflation port 329. When control tube extension 321 is in the actuated position, as depicted in FIG. 10, apertures 333 are sealed off from annular space 327 by the inner diameter of lower control housing 325. In this example, at least one seal 335 is positioned axially above the axial location of the apertures 333 in the actuated position, and at least one seal 337 is positioned axially below the axial location of the apertures 333 in the actuated position. seals 335, 337 may be provided to assist with maintaining a seal throughout the sliding traverse of control tube extension 321. The positioning of apertures 333 determines the cut-off characteristics of the connection between bore and annular space 327. As depicted, apertures 333 are circular and disposed circumferentially about control tube extension 321. One of ordinary skill in the art would understand that the number, shape, and distribution of apertures may be varied without deviating from the scope of this disclosure.

The axial distance between lower interior flange 331 and topmost extent of apertures 333 defines a packer cut-off length B, which is the distance control tube extension 321 must traverse axially downward before the fluid connection between the bore and annular space 327 is severed.

Figure 3:
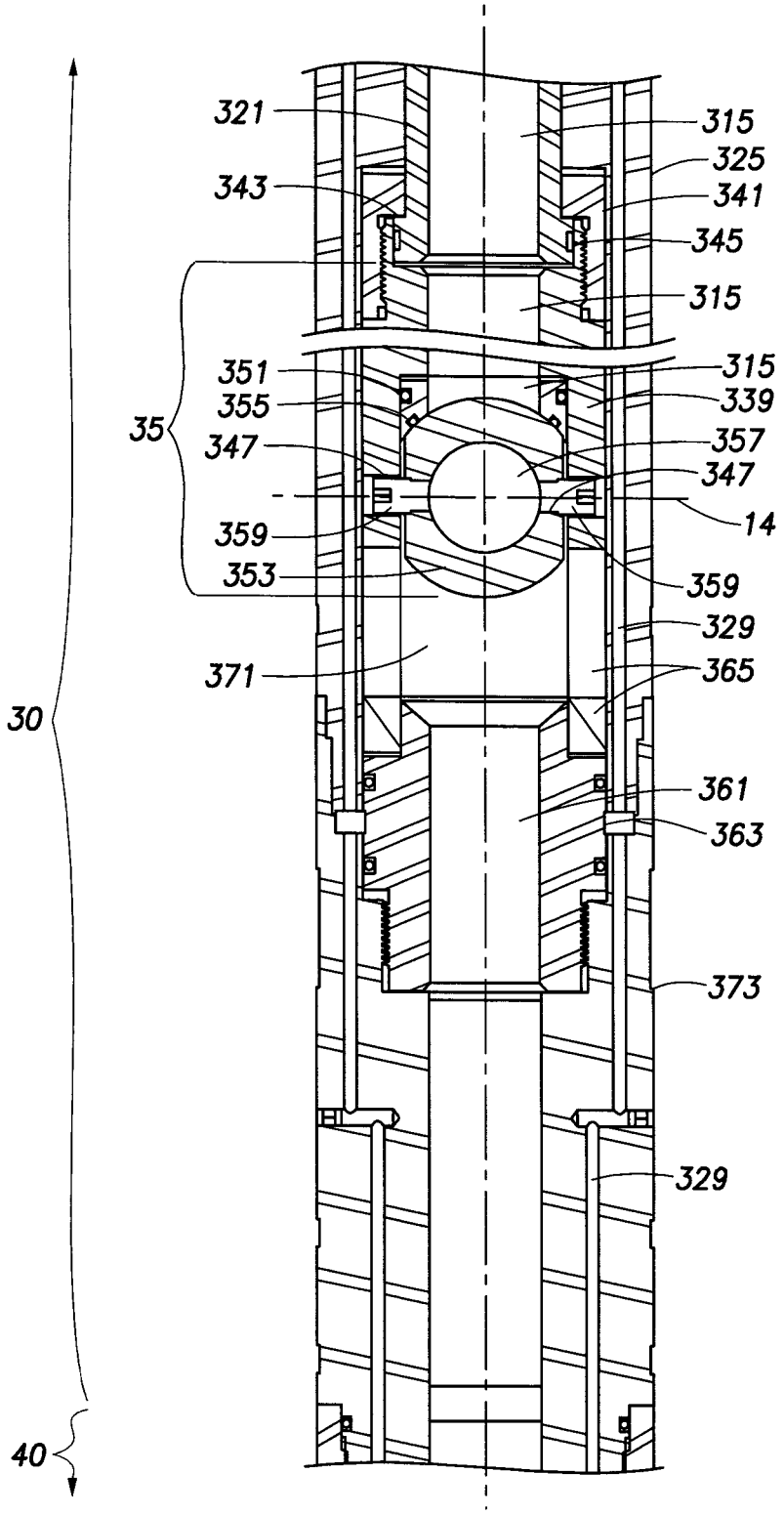
FIG. 3 is a continuation of the partial cross-section of FIG. 2 depicting a "run-in configuration" consistent with at least one embodiment of the present disclosure.
Figure 4:
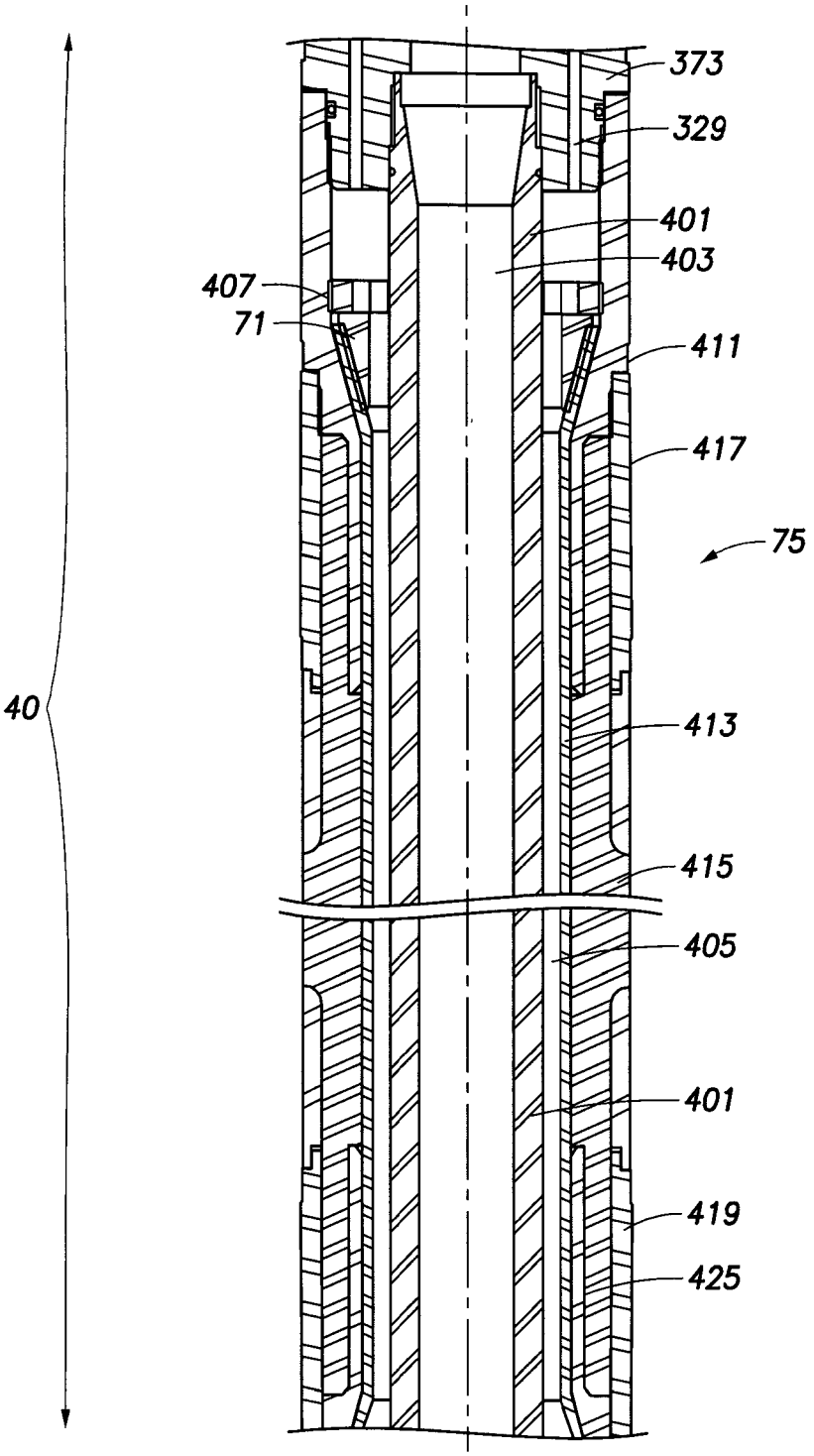
FIG. 4 is a continuation of the partial cross-section of FIG. 3.

Referring now to FIG. 3, control tube extension 321 continues axially downward within the bore of lower control housing 325. The lower end of control tube extension 321 is coupled to the upper end of shift sleeve 339 by retainer nut 341. In this example, retainer nut 341 is threadedly connected to the upper outer wall of shift sleeve 339, and secures over outward flange 343 of the lower outer wall of control tube extension 321. The upper end of shift sleeve 339 fits annularly around the lower end of control tube extension 321. Debris barrier 345, located in the annular interface between shift sleeve 339 and control tube extension 321, contains at least one fluid path allowing fluid to escape the bore of shift sleeve 339 and control tube extension 321.

Figure 13:
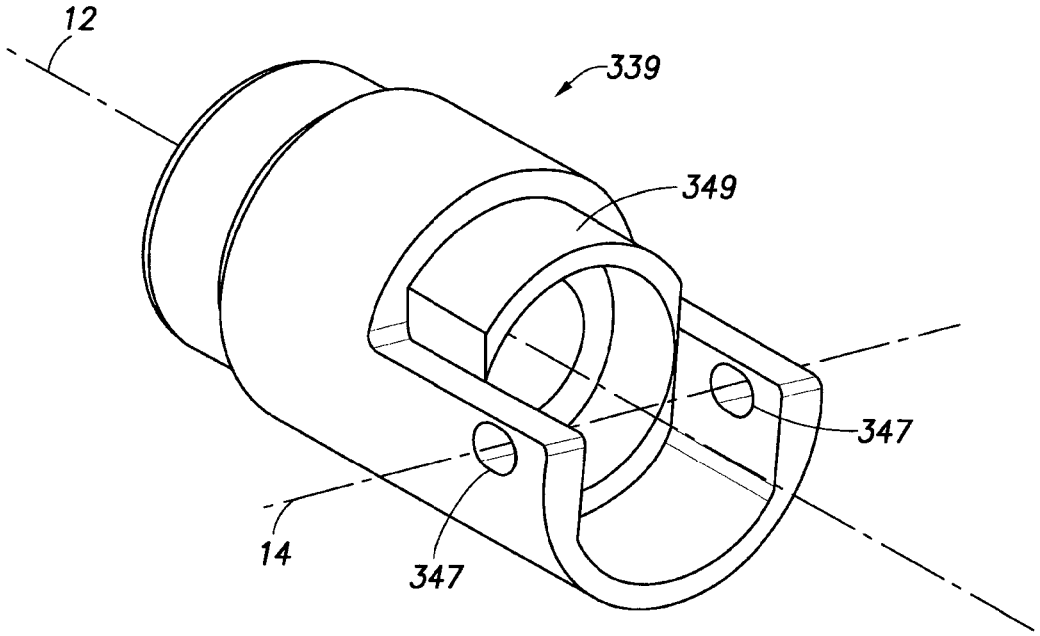
FIG. 13 is a perspective view of a shift sleeve and ball seat consistent with at least one embodiment of the present disclosure.

Shift sleeve 339, shown in detail in FIG. 13, is a generally cylindrical tube extending axially downward, the bore of which fluidly connecting to and forming a continuation of valve sub bore 315. The lower end of shift sleeve 339 may include valve axle holes 347 along valve axle axis 14. Valve axle axis 14 is coincident and orthogonal to central axis 12. A portion of one side of the lower end of shift sleeve 339 is "cut away" along a plane parallel to central axis 12 and a plane parallel to valve axle axis 14. At the cut away portion, shift sleeve 339 is coupled to ball seat 349. Ball seat 349 is a generally cylindrical tube which fits within an inset of shift sleeve 339, the bore of which fluidly connecting to and forming a continuation of valve sub bore 315. One or more seals 351 may be used to ensure a fluid seal between ball seat 349 and shift sleeve 339.

Referring back to FIG. 3, the lower end of ball seat 349 is adapted to closely fit against the surface of rotatable ball 353. In at least one embodiment, the lower end of ball seat 349 is coupled to shift sleeve 339 so that ball seat 349 can move axially or "float" relative to rotatable ball 353 and shift sleeve 339 so that ball seat 349 forms sealing contact when fluid is pumped into the valve sub bore 315. One or more seals 355 may be used to ensure there is a sufficient seal between ball seat 349 and rotatable ball 353 to reliably divert fluid to inflate the packer elements with a prescribed volumetric flow rate. Rotatable ball 353 is generally spherical with valve bore 357 through its center. Rotatable ball 353 is rotatably coupled to shift sleeve 339 by valve axle pins 359, and may freely rotate about valve axle axis 14. Rotatable ball 353 is positioned to rotate approximately 90° when transitioned from its run-in position, shown in FIG. 3, to its actuated position, shown in FIG. 11. In the run-in position illustrated in FIG. 3, valve bore 357 is oriented to not form a continuous fluid pathway with valve sub bore 315. In the actuated position illustrated in FIG. 11, control tube extension 321, retainer nut 341, shift sleeve 339, ball seat 349, and rotatable ball 353 have translated downward a distance of stroke-length A in response to downward force of control tube 301. Rotatable ball 353 has also rotated approximately 90° about valve axle axis 14, thereby aligning valve bore 357 with central axis 12 and allowing fluid communication between valve sub bore 315 and valve output bore 361.

Rotatable ball 353 in the actuated position abuts the upper edge of pressure tube 363 and forms a continuous fluid connection between valve sub bore 315 and valve output bore 361. The top surface of pressure tube 363 forms a lower valve seat which is adapted to closely fit the surface of rotatable ball 353.

Figure 12A:
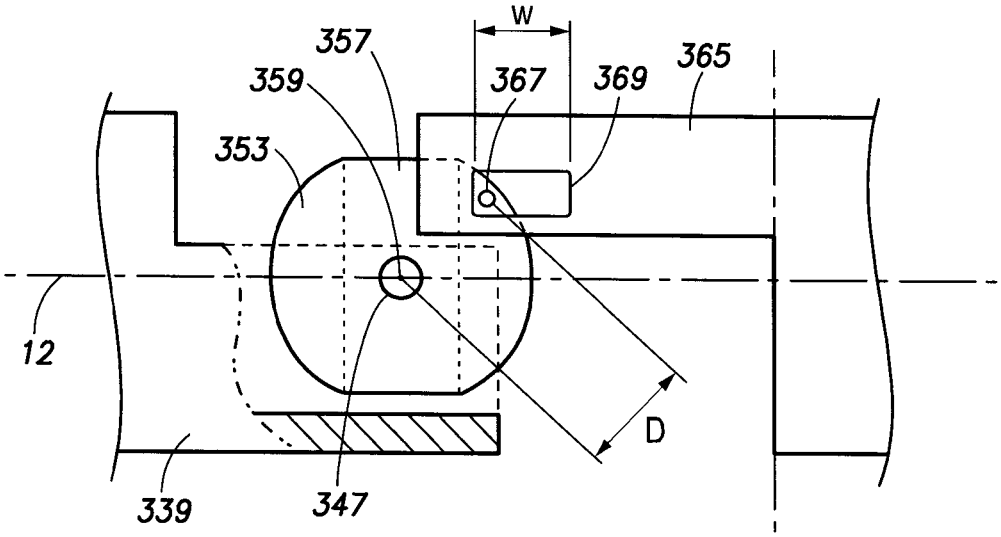
FIG. 12A is a partial cross section of components of the tool of FIGS. 1A-1C in a "run-in configuration" consistent with at least one embodiment of the present disclosure.
Figure 12B:
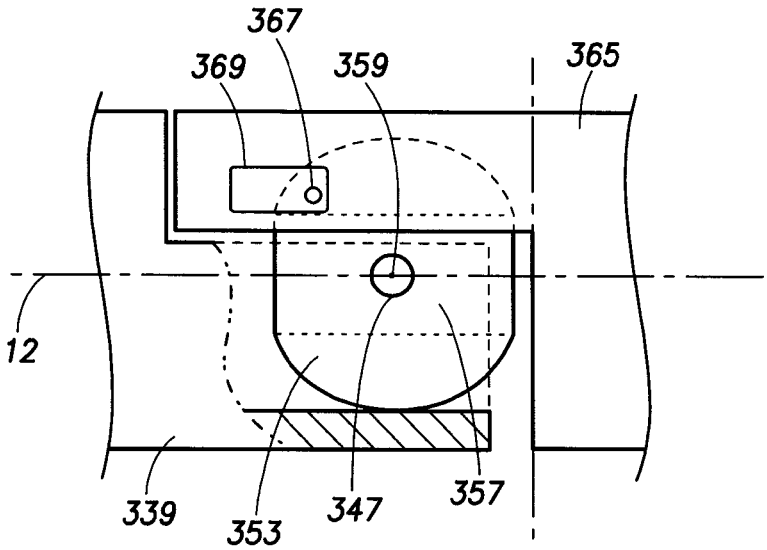
FIG. 12B is a partial cross section of the components depicted in FIG. 12A in an "actuated configuration" consistent with at least one embodiment of the present disclosure.
Figure 14:
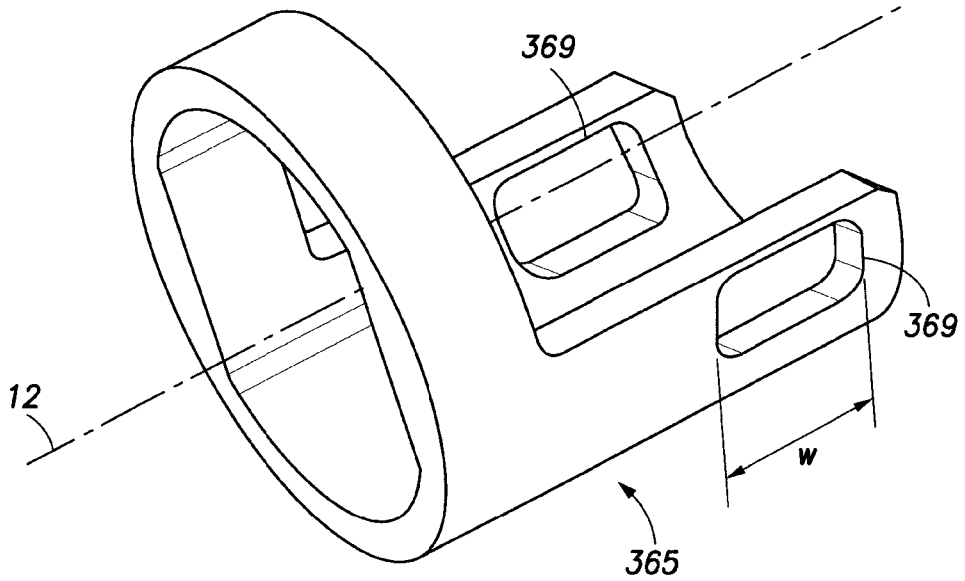
FIG. 14 is a perspective view of a rotation pin sleeve consistent with at least one embodiment of the present disclosure.

Rotatable ball 353 is actuated by rotation pin sleeve 365. Shift sleeve 339, rotatable ball 353, and rotation pin sleeve 365 are shown in detail in FIGS. 12A-12B. Rotation pin sleeve 365 is shown separately in FIG. 14. Ball seat 349 and pressure tube 363 are likewise not shown and shift sleeve 339 is in partial cross-section to aid with understanding of functionality. FIG. 12A shows the run-in configuration and FIG. 12B shows the actuated configuration of the parts. Rotatable ball 353 is coupled to rotation pin sleeve 365 by rotation pin 367. Rotation pin 367 extends parallel to valve axle axis 14 (not shown) and is positioned eccentrically on the surface of rotatable ball 353. Rotation pin 367 fits into rotation window 369 formed in rotation pin sleeve 365.

In the run-in configuration of FIG. 12A, valve bore 357 is not aligned with central axis 12, thereby restricting flow to valve output bore 361 (not shown), defining a "closed" position. As shift sleeve 339 and rotatable ball 353 are forced axially downward (depicted here as a translation to the right), rotation pin 367 travels axially within rotation window 369. During the initial movement within a distance of ball seal retention length C, rotatable ball 353 remains in the closed position. Ball seal retention length C can be approximated by the following equation:

$$C=w-d_{rotation\ pin}$$

where w is the axial length of rotation window 369, and $d_{rotation\ pin}$ is the diameter of rotation pin 367.

Rotation pin 367 is positioned a selected distance from valve axle axis 14, defining a rotation pin eccentricity length D. Rotation pin 367 is positioned along a line extending 45 degrees from central axis 12. Eccentricity length D is selected such that rotatable ball 353 is rotated approximately 90° when shift sleeve 339 is moved stroke length A with a ball seal retention length C.

Once shift sleeve 339 and rotatable ball 353 have moved ball seal retention length C, rotation pin 367 contacts the wall of rotation window 369. As shift sleeve 339 continues to move, rotatable ball 353 is rotated about valve axle axis 14 by the resultant force applied by rotation pin sleeve 365 on rotation pin 367 through the wall of rotation window 369. As rotatable ball 353 rotates, valve bore 357 begins to open fluid communication between valve sub bore 315 and valve bore 357, and subsequently valve output bore 361. Ball seal retention length C is selected such that it is greater than packer cut-off length B in order to prevent fluid communication between valve sub bore 315 and valve bore 357 until after apertures 333 have seated within lower control housing 325. Once shift sleeve 339 and rotatable ball 353 have moved stroke length A, valve bore 357 is aligned with central axis 12, thereby allowing fluid continuous flow between valve sub bore 315 and valve output bore 361.

Likewise, as shift sleeve 339 and rotatable ball 353 are moved axially upward, rotation pin 367 contacts the other wall of rotation window 369. As shift sleeve 339 and rotatable ball 353 continue to move upward, the resultant force causes rotatable ball to rotate back approximately 90°, thereby isolating valve sub bore 315 from valve output bore 361 and returning to its run-in configuration. Geometry of rotation window 369 is selected such that rotatable ball 353 remains at least partially open when apertures 333 are opened to annular space 327.

Referring back to FIG. 3, valve operating chamber 371 is defined by the inner wall of lower control housing 325, rotatable ball 353 and shift sleeve 339, and pressure tube 363 and rotation pin sleeve 365. As shift sleeve 339 and rotatable ball 353 are shifted into the actuated position, valve operating chamber 371 decreases in volume. Any trapped fluid is permitted to return to valve sub bore 315 from operating chamber 371 through grooves (not shown) in debris barrier 345.

Lower end of lower control housing 325 is coupled to the upper end of crossover housing 373. Crossover housing 373 may include at least one port formed in its wall to form a continuation of packer inflation port 329. Crossover housing 373 is a generally cylindrical tube extending downward along central axis 12. Crossover housing 373 is depicted as threadedly coupled to control housing 325. Pressure tube 363 is coupled within the upper bore of crossover housing 373. Continuing to FIG. 4, crossover housing 373 is coupled to upper packer sub 40.

Upper packer sub 40 is a generally cylindrical tube, including upper packer mandrel 401 having upper packer bore 403 fluidly connected to valve output bore 361. Upper packer sub 40 is configured to allow fluid to flow from packer inflation port 329 to the interior of upper packer 405. Upper packer sub 40 may include upper ring 407 which is threadedly connected to downwardly and inwardly tapered member 409, thereby compressively sealing the end of upper packer 405 against the interior of upper packer housing 411. Holes in upper ring 407 pass fluid from packer inflation port 329 to the interior of upper packer 405. Upper packer 405 may include upper packer inner layer 413 and upper packer outer layer 415, both depicted as elastomeric material, and upper and lower metal packer shields 417, 419. Upper and lower metal packer shields 417, 419 may be configured to control the inflation of upper packer 405.

Figure 5:
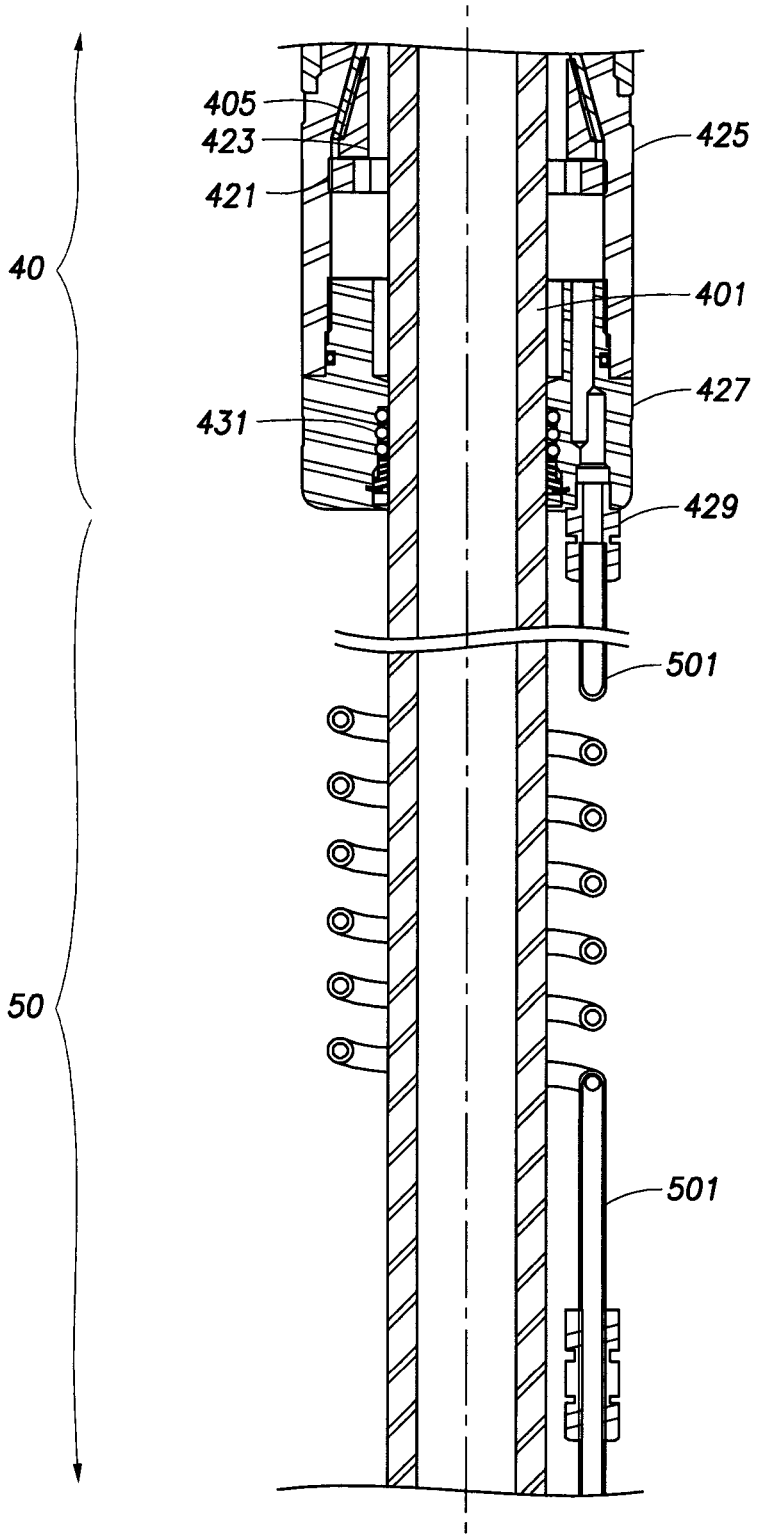
FIG. 5 is a continuation of the partial cross-section of FIG. 4.

FIG. 5 depicts the lower end of upper packer sub 40, including lower ring 421 which is threadedly connected to upwardly and inwardly tapered member 423, compressing the end of upper packer 405 against the interior of lower packer housing 425. Holes in lower ring 421 allow fluid to pass from upper packer 405 to upper packer bottom housing 427, which may include upper packer hose connector 429. Upper packer hose connector 429 allows fluid to pass from upper packer bottom housing 427 through hose 501, which fluidly connects to lower packer sub 60. Upper packer bottom housing 427 may also include at least one seal 431 to isolate fluid in the wellbore from fluid used to inflate the packers.

Figure 6:
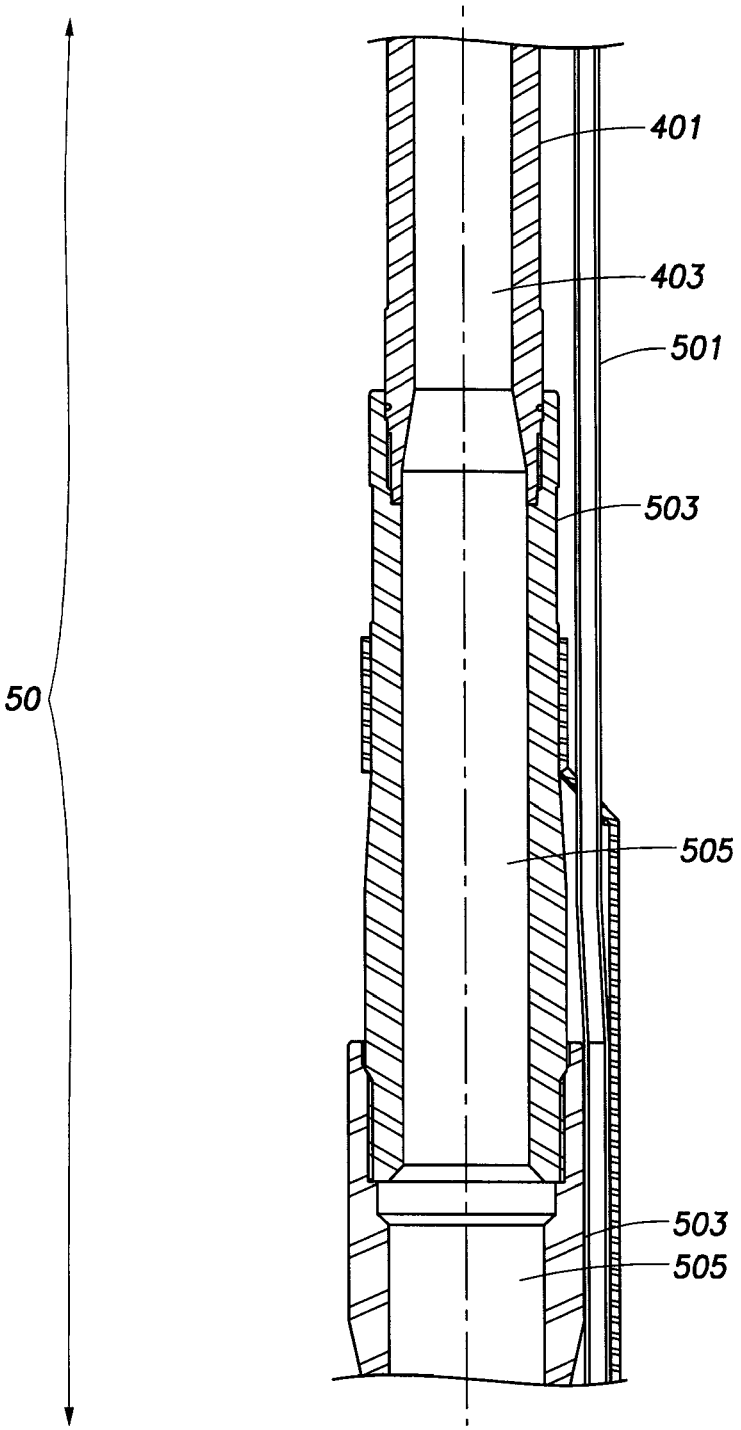
FIG. 6 is a continuation of the partial cross-section of FIG. 5.
Figure 7:
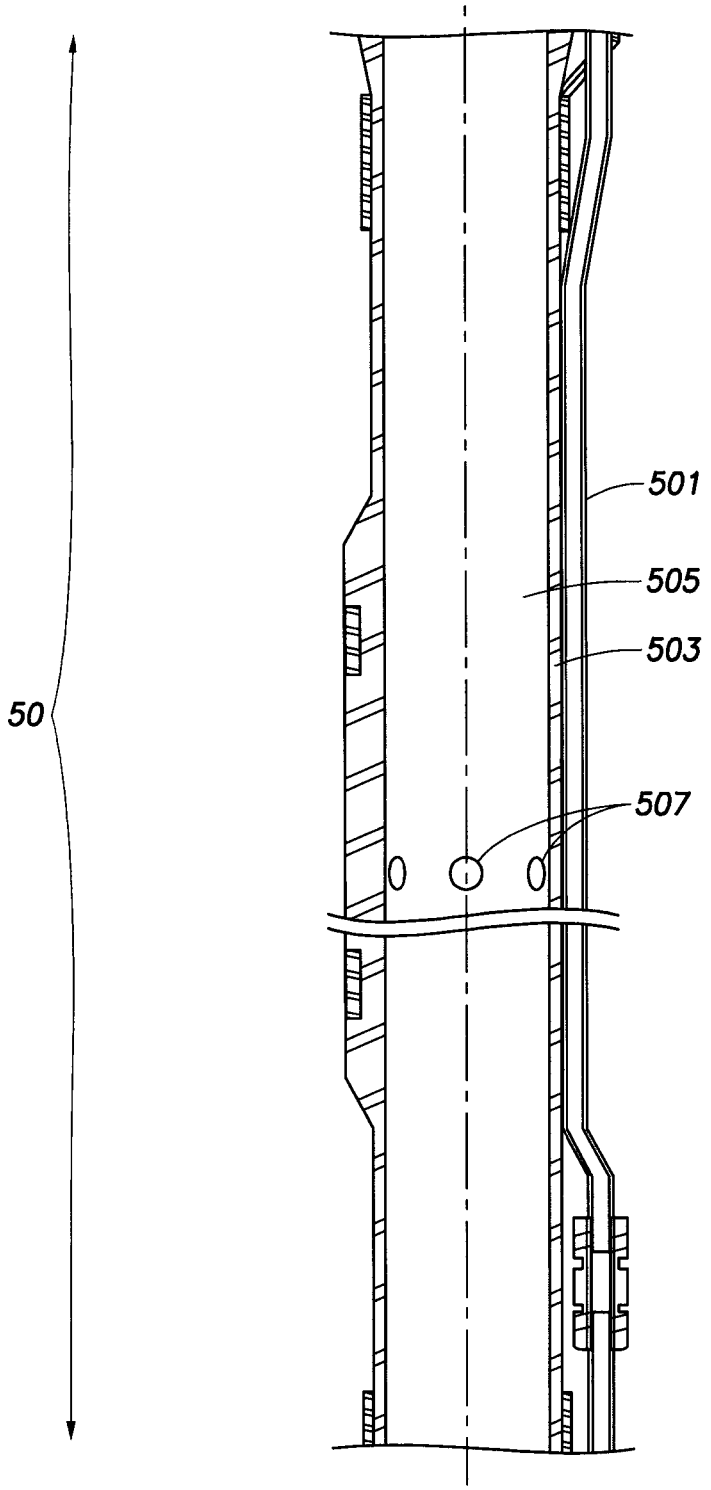
FIG. 7 is a continuation of the partial cross-section of FIG. 6.
Figure 8:
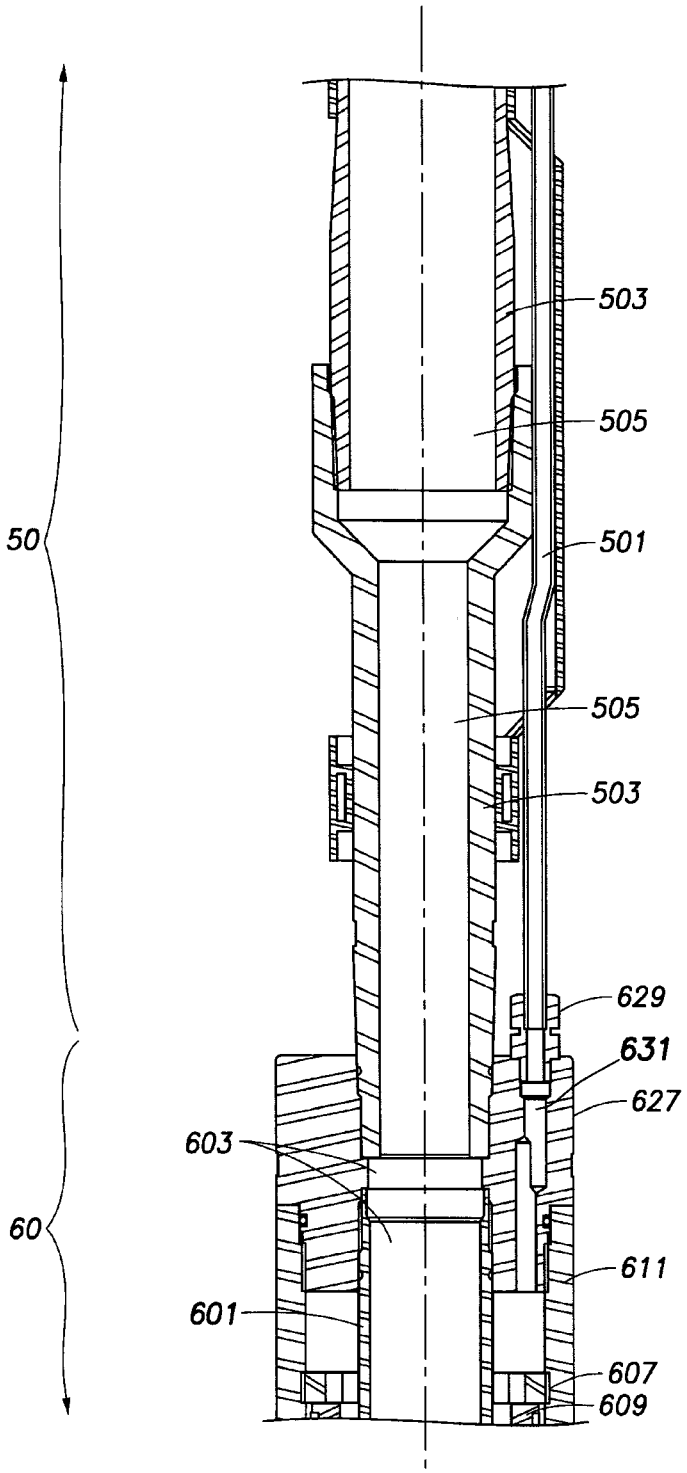
FIG. 8 is a continuation of the partial cross-section of FIG. 7.

Continuing to FIGS. 6-8, upper packer mandrel 401 continues axially downward and couples to at least one fracing mandrel 503. Fracing mandrel 503 has fracing sub bore 505 fluidly connected to upper packer bore. Fracing mandrel 503 may include one or more fracing apertures 507 which connects fracing sub bore 505 with the wellbore surrounding fracing mandrel 503, thereby allowing for hydraulic fracturing of a surrounding formation (not shown). The exemplary embodiment shown by the figures may include multiple lengths of pipe to make up fracing mandrel 503. The displayed configuration of fracing mandrel 503, including, for example, number of pipes, length of pipe sections, overall length, and configuration of pipe, will be understood by one of ordinary skill in the art to be only an example, and any reconfiguration would not deviate from the scope of this disclosure. Likewise, the configuration of fracing apertures 507, including, for example, number, shape, and positioning of fracing apertures, will be understood by one of ordinary skill in the art to be only an example, and any reconfiguration would not deviate from the scope of this disclosure.

Hose 501 is shown continuing downward through the wellbore, having various fittings and configurations to, for example, secure additional lengths of hose, couple hose 501 to fracing mandrel 503, allow strain relief, etc. One of ordinary skill in the art will readily understand that the configuration shown in the figures is meant only as an example, and any reconfiguration would not deviate from the scope of this disclosure.

Fracing mandrel 503 couples, at its lower end, to upper end of lower packer sub 60, here shown as threadedly connected to lower packer top housing 627. Lower packer top housing 627 may include lower packer bore 603 fluidly connected to fracing sub bore 505. Lower packer top housing 627 is coupled at its lower end to the upper end of lower packer mandrel 601, the bore of which fluidly connected to and forming an extension of lower packer bore 603.

Lower packer top housing 627 may also include lower packer hose connector 629 which is coupled to hose 501 and allows fluid to pass from hose 501 to lower packer sub 60, thereby connecting upper packer sub 40 to lower packer sub 60. Fluid from hose 501 can pass through at least one inflation port 631 to the interior of lower packer 605.

Figure 9:
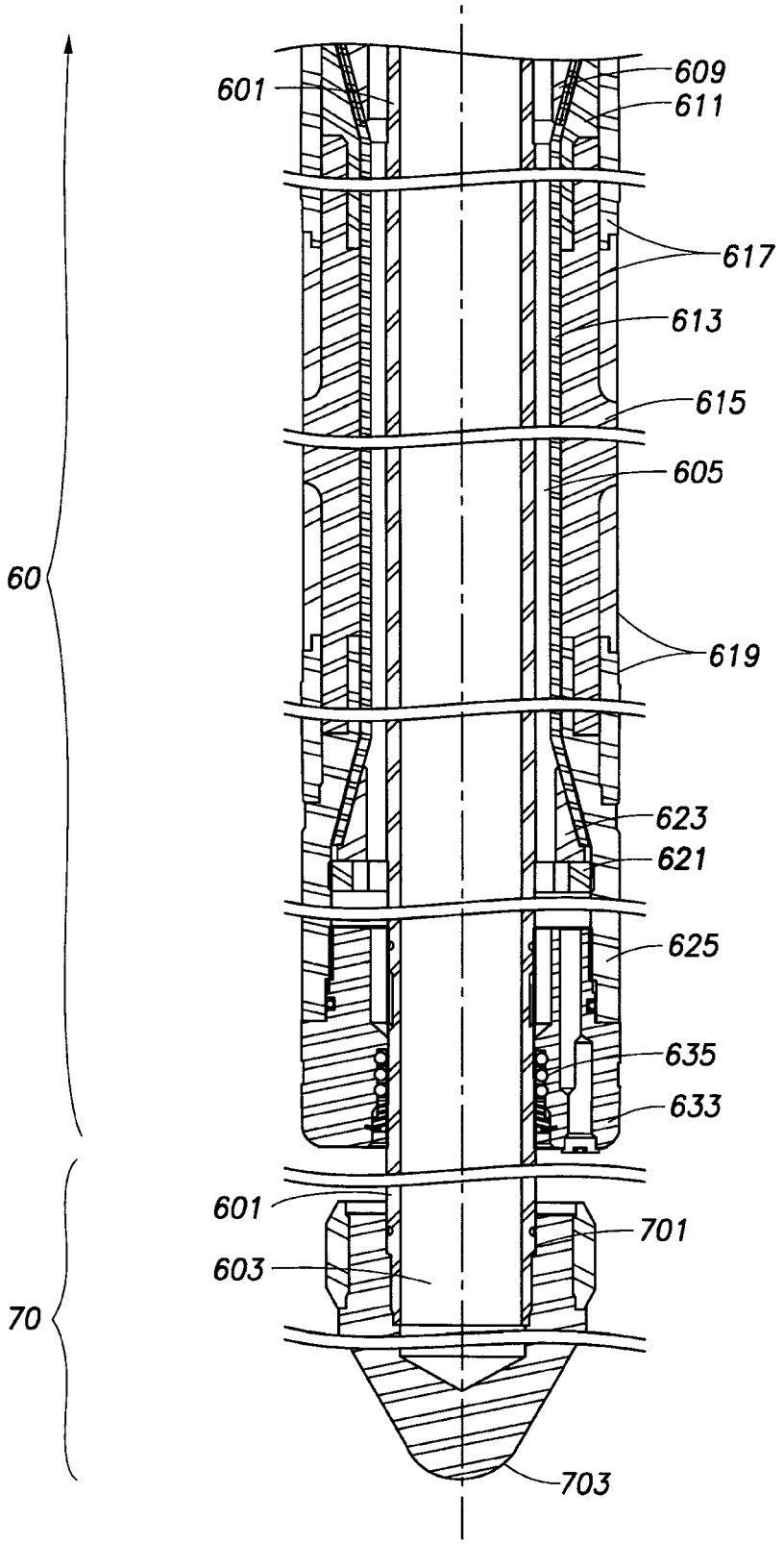
FIG. 9 is a continuation of the partial cross-section of FIG. 8.

Referring to FIGS. 8, 9, Lower packer sub 60 may include upper ring 607 which is threadedly connected to downwardly and inwardly tapered member 609, thereby compressively sealing the end of lower packer 605 against the interior of upper packer housing 611. Holes in upper ring 607 pass fluid from inflation port 631 to the interior of lower packer 605. Lower packer 605 may include lower packer inner layer 613 and lower packer outer layer 615, both depicted as elastomeric material, and at least one upper and lower metal packer shield 617, 619. Upper and lower metal packer shields 617, 619 may be configured to control the inflation of upper packer 605. The lower end of lower packer sub 60 may include lower ring 621 which is threadedly connected to upwardly and inwardly tapered member 623, compressing the end of lower packer 605 against the interior of lower packer housing 625. Here, lower packer sub 60 is shown to have a lower packer bottom housing 633 including at least one seal 635 to isolate fluid in the wellbore from fluid used to inflate the packers.

Lower end of lower packer mandrel 601 is coupled to nose sub 70. Nose sub 70 may include a coupling 701 adapted to receive the lower end of packer mandrel 601. Nose sub 70 may further include nose housing 703. Here, nose housing 703 is depicted as a rounded cone. Nose housing 703 is adapted to, for example, plug the end of lower packer bore 603, thereby allowing for pressurization of lower packer bore 603, fracing sub bore 505, upper packer bore 403, and valve output bore 361 when valve sub 30 is configured in the actuated position and fluid pressure is applied to the bore of the work string. Nose housing 703 is configured to have a shape suitable for guiding downhole fracing tool 10 through any deviations of the downhole wellbore.

Figure 15:
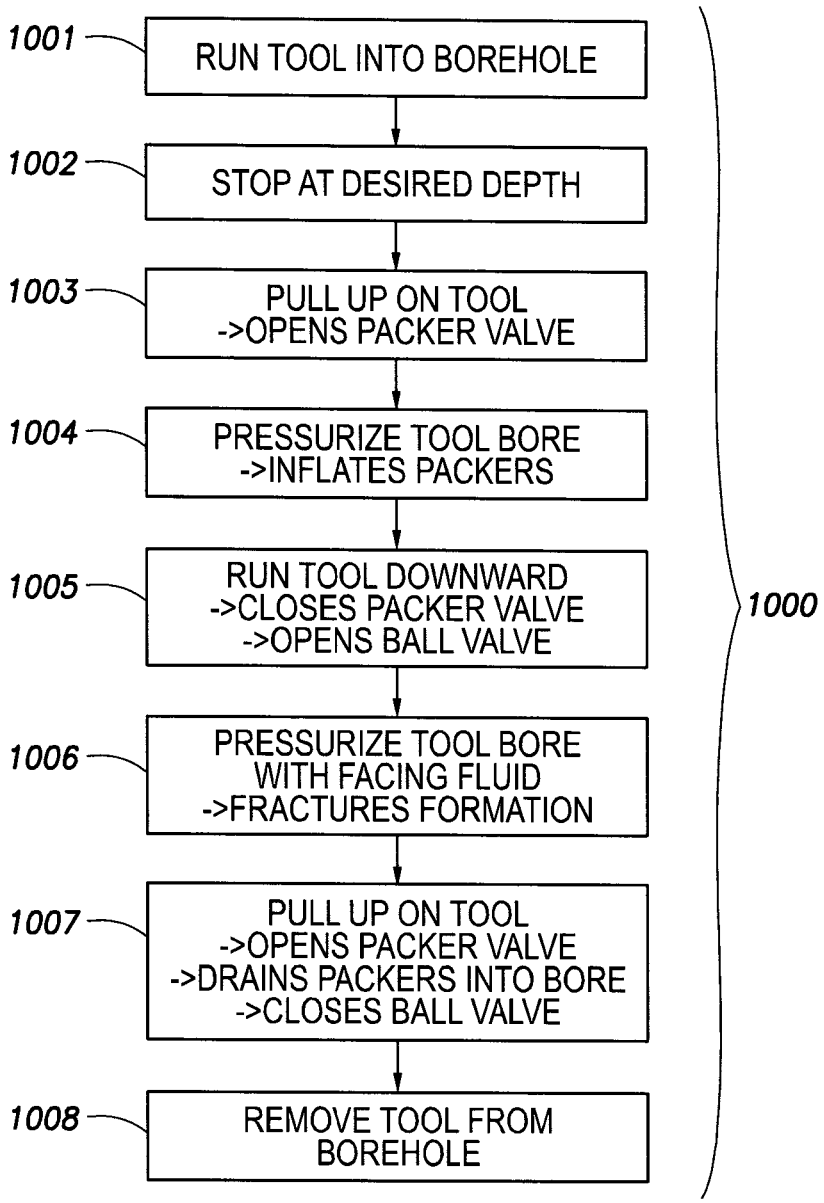
FIG. 15 is a flow-chart consistent with at least one embodiment of the present disclosure.

To aid in understanding of the operation of a device consistent with at least one embodiment of this disclosure, FIG. 15 outlines an exemplary fracing operation using downhole fracing tool 10 as described herein and illustrated in FIGS. 1-14. The order of operations is only meant as an example, and one of ordinary skill in the art would understand that operation order and continuity is not critical for the use of a tool or method within the scope of this disclosure.

To begin fracing operation 1000 of a specific formation of an existing wellbore, downhole fracing tool 10 is run into the wellbore at, for example, the end of a tool string. During the run-in operation, fluid may passed through both the wellbore and the tool string bore at approximately equal pressure. Doing so may aid in lubrication and steering of the tool string, as well as prevent the packers from premature inflation. Once downhole fracing tool 10 has reached the target depth, the tool string descent is halted. The target depth is specified such that the formation is located approximately between upper packer sub 40 and lower packer sub 60, thereby allowing fluid communication between fracing sub 50 and the wellbore at the formation.

During the run-in operation, frictional resistance on downhole fracing tool 10 applies an upward axial force on the lower end of the tool, causing a resultant downward force on control tube 301. The frictional resistance may be caused by, for example, fluid skin friction or from contact with the wall. When used in wells requiring large amounts of steering, such as in horizontal wells, such resistance may be significant. To prevent downhole fracing tool 10 from prematurely transitioning from run-in to actuated configuration, spring 309 is under compression and thereby resists any movement of control tube 301 into upper control housing 305. Additionally, tool string may be pulled upward slightly when downhole fracing tool 10 is positioned at target depth, thereby using resistive forces to fully return control tube 301 to run-in position.

In the run in position, as illustrated in FIG. 2 and previously described, apertures 333 allow fluid communication from the surface to upper and lower packer subs 40, 60, via the tool string bore, string connection sub bore 215, valve sub bore 315, annular space 327, packer inflation port 329, and—for lower packer sub 60—hose 501. At the same time, rotatable ball 353 visible in FIG. 3, is positioned to seal the lower end of valve sub bore 315, thereby allowing fluid pressure to build up in the packers. By applying fluid pressure while in the run-in position, upper and lower packers 405, 605 may thereby be inflated against the wellbore. Upper and lower packer subs 40, 60 are configured such that the inflation of upper and lower packers 405, 605 creates a fluid seal between the wellbore above each packer and the wellbore below each packer. Therefore, by inflating both upper and lower packer 405, 605, the portion of wellbore between them is fluidly isolated from the rest of the wellbore. In order to prevent over-pressurization of the packers, debris barrier 345 allows a selected amount of fluid to flow from valve sub bore 305 to valve operating chamber 371 and therefore into valve output bore 361, upper packer bore 403, and fracing sub bore 505 where it can escape through fracing aperture 507 into the wellbore.

Once upper and lower packer subs 40, 60 are fully inflated, the tool string is stroked downward. The pressure of the packers on the wellbore cause the downhole fracing tool to remain stationary, while control tube 301 moves downward into its actuated position. Tool string weight is sufficient to compress spring 309. As control tube 301 moves axially downward, its attached components, including control tube extension 321, shift sleeve 339, retainer nut 341, debris barrier 345, and rotatable ball 353—defining ball valve unit 35—also move downward within upper and lower control housings 305, 325. Once ball valve unit 35 has translated axially downward packer cut-off length B, apertures 333 are covered by the inner wall of lower control housing 325, and fluid communication between valve bore 315 and upper and lower packer subs 40, 60 is closed. However, until ball-valve unit 35 has translated axially downward ball seal retention length C, rotatable ball 353 remains closed, thereby preventing packers from prematurely draining into valve output bore 361, and eventually into the wellbore. Any fluid trapped in valve operating chamber 371 as ball valve unit 35 moves into valve operating chamber 371 may flow through grooves formed in debris barrier 345, thereby mitigating any hydraulic lock which may prevent movement of ball valve unit 35.

Once ball valve unit 35 has translated axially downward ball seal retention length C, rotation pin 367 contacts the wall of rotation window 369. As ball valve unit 35 continues to move, rotatable ball 353 is rotated about valve axle axis 14 by the resultant force applied by rotation pin sleeve 365 on rotation pin 367 through the wall of rotation window 369. As rotatable ball 353 rotates, valve bore 357 begins to open fluid communication between valve sub bore 315 and valve bore 357, and subsequently valve output bore 361. As depicted in FIG. 11, once ball valve unit 35 has moved stroke length A, valve bore 357 is aligned with central axis 12, thereby allowing fluid continuous flow between valve sub bore 315 and valve output bore 361. Tool string movement is now again halted in response to the contact of flanged groove 313 against lower interior flange 331.

Since the bore of downhole fracing tool 10 is now open, fracing operations can commence. In hydraulic fracturing, for example, fracing fluid is pumped down the tool bore at high pressure. The bore of downhole fracing tool 10 is sealed by nose sub 70 at the bottom. Fracing fluid is therefore expelled into the wellbore between upper and lower packer subs 40, 60 through fracing aperture 507. Additional fracing operations, for example, proppant injection, etc. may be performed as well.

At the completion of fracing operations, the tool string is pulled axially upward. Once the tool string is pulled axially upward a distance defined as packer release length D, defined as the difference between stroke length A and packer cut-off length B, (D=A−B), apertures 333 begin to pass the inner wall of lower control housing 325. At this point, fluid communication between upper and lower packer subs 40, 60 to valve sub bore 315 is reestablished, allowing upper and lower packer 405, 605 to drain into valve sub bore 315. The geometry of rotation window 369 is selected such that rotatable ball 353 remains at least partially open when upper and lower packer 405, 605 are drained, allowing the fluid used for their inflation to drain down the still open bore of downhole fracing tool 10 and out into the wellbore through fracing aperture 507.

As tool string continues to retract, ball valve unit 35 continues to move axially upward, causing rotation pin 367 to contact the other wall of rotation window 369. Rotatable ball 353 rotates approximately 90°, returning to its run-in position thereby isolating valve sub bore 315 from valve output bore 361. Tool string and downhole fracing tool 10 are removed from the well as tool string is retracted.

One of ordinary skill in the art will understand that the specific configuration described herein and depicted in the Figures is only an example to aid in understanding of the device. For example, valve sub 30 may include multiple housings to, among other purposes, aid in assembly of the tool. Other configurations and numbers of housing are possible, and one having ordinary skill in the art will understand that any alternate configuration will not deviate from the scope of this disclosure. Additionally, although valve sub 30 is described so that a downward movement of the work string transitions it from run-in to actuated configuration, valve sub 30 may be reconfigured such that an upward movement of the work string is used to transition it from run-in to actuated configuration.

Likewise, upper packer sub 40, fracing sub 50, and lower packer sub 60 are described and illustrated in one exemplary configuration. Indeed, any fluid-energized packer may be substituted for either packer sub without deviating from the scope of this disclosure. Indeed, one packer sub may be omitted entirely without deviating from the scope of this disclosure. Similarly, fracing sub 50 may be replaced by any device capable of hydraulically fracturing a surrounding formation without deviating from the scope of this disclosure. The relative lengths and number of sub sections, as well as the specific configuration, including lengths, diameters, and sub order may likewise be varied within the scope of this disclosure. Additionally, although subs are here depicted as connecting directly together, it will be understood that additional lengths of mandrel, lengths of tubing, or additional subs may be inserted between the subs described in this disclosure without deviating from the scope of this disclosure.

Additionally, one of ordinary skill in the art with benefit of this disclosure will understand that the rotatable ball 353, although depicted and described as having one aperture—valve bore 357—may include multiple flow paths therethrough to allow selective fluid communication. One of ordinary skill in the art with benefit of this disclosure will also understand that the ball may be replaced with a flapper operating in largely the same fashion without deviating from the scope of the disclosure.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure and that they may make various changes, substitutions and alterations herein without departing from the spirit and scope of the present disclosure.

The invention claimed is:

1. A downhole tool on a tool string having a tool string bore positionable in a wellbore having a wellbore axis, the downhole tool comprising:

a first packer sub coupled to the tool string, the packer sub having a first inflatable element and a first packer inflation port;

a valve sub coupled to the tool string, the valve sub having:

a valve sub housing, the valve sub housing being generally tubular having at least one packer supply port in fluid communication with the packer inflation port;

a control tube, the control tube being generally tubular and aligned with the valve sub housing and having an upper and lower end, the upper end coupled to the tool string, and the lower end positioned within the bore of the valve sub housing, the control tube having a bore and at least one aperture through its side wall, the control tube having an open position in which the aperture provides fluid communication between the bore of the control tube and the packer supply port, and a closed position in which the apertures are covered by the inner wall of the valve sub housing and the bore of the control tube, the control tube bore being in fluid communication with the tool string bore;

a shift sleeve coupled to the lower end of the control tube having a hole adapted to accept an axle pin;

a rotatable ball adapted to rotate about the axle pin, the rotatable ball having at least one flow path through its body, the rotatable ball having an open position and a closed position selected by the upward or downward movement of the tool string, the open and closed positions of the rotatable ball being in opposition to the open and closed position of the control tube, thereby allowing or preventing fluid flow through the at least one flow path from the tool string bore and the bore of the control tube, the rotatable ball having a rotation pin extending from its outer surface; and a rotation pin sleeve coupled to the rotation pin adapted to rotate the ball from the closed position to the open position in response to a movement of the ball toward or away from the rotation pin sleeve.

2. The downhole tool of claim 1, further comprising:

an upper valve seat floatingly coupled to the shift sleeve to sealingly contact the rotatable ball in response to fluid pressure applied within the shift sleeve when the rotatable ball is in the closed position.

3. The downhole tool of claim 1, further comprising:

a lower valve seat positioned to sealingly contact the rotatable ball when the ball is in the open position, the lower valve seat having a bore in fluid communication with the at least one flow path when the rotatable ball is in the open position, the lower valve seat positioned spaced apart from the rotatable ball when the rotatable ball is in the closed position.

4. The downhole tool of claim 1, further comprising:

a perforated pipe coupled to the tool string and in fluid communication with the tool string bore when the rotatable ball is in the open position, the perforated pipe comprising at least one aperture to allow a fluid to flow from the bore of the perforated pipe to the wellbore and a surrounding formation.

5. The downhole tool of claim 4, wherein the downhole tool further comprises:

a second packer sub, the second packer sub coupled to the tool string and having a second inflatable element and a second packer inflation port, the second packer inflation port in fluid communication with the packer supply port of the valve sub housing.

6. The downhole tool of claim 5, wherein:

the first packer sub further comprises a communication port, the communication port coupled to the inflation port of the second packer sub thereby coupling the second packer sub to the packer supply port of the valve sub housing via the inflatable element of the first packer sub.

7. The downhole tool of claim 6, wherein:

the first packer sub and the second packer sub are positioned above and below the at least one aperture of the perforated pipe and configured to isolate the wellbore between the first inflatable element and the second inflatable element.

8. The downhole tool of claim 1, further comprising:

a spring positioned to bias the rotatable ball into the closed position and the control tube apertures into an open position.

9. The downhole tool of claim 1, wherein:

the rotatable ball is transitioned from the closed position to the open position and the control tube apertures are transitioned from the open position to the closed position by a downward movement of the tool string.

10. A method comprising:

providing a first packer sub coupled to the tool string, the packer sub having a first inflatable element and a first packer inflation port;

providing a valve sub coupled to the tool string, the valve sub having:

a valve sub housing, the valve sub housing being generally tubular having at least one packer supply port in fluid communication with the packer inflation port;

a control tube, the control tube being generally tubular and aligned with the valve sub housing and having an upper and lower end, the upper end coupled to the tool string, and the lower end positioned within the bore of the valve sub housing, the control tube having a bore and at least one aperture through its side wall, the control tube having an open position in which the aperture provides fluid communication between the bore of the control tube and the packer supply port, and a closed position in which the apertures are covered by the inner wall of the valve sub housing and the bore of the control tube, the position selected by an upward or downward movement of the tool string, the control tube bore being in fluid communication with the tool string bore;

a shift sleeve coupled to the lower end of the control tube having a hole adapted to accept an axle pin;

a rotatable ball adapted to rotate about the axle pin, the rotatable ball having at least one flow path through its body, the rotatable ball having an open position and a closed position selected by the upward or downward movement of the tool string, the open and closed positions of the rotatable ball being in opposition to the open and closed position of the control tube, thereby allowing or preventing fluid flow through the at least one flow path from the tool string bore and the bore of the control tube, the rotatable ball having a rotation pin extending from its outer surface; and a rotation pin sleeve coupled to the rotation pin adapted to transition the rotatable ball from the closed position to the open position in response to a movement of the rotatable ball toward or away from the rotation pin sleeve;

running the downhole tool to a desired position;

filling the first inflatable element;

transitioning the control tube into the closed position and transitioning the rotatable ball into the open position;

pumping fluid through the tool bore;

transitioning the control tube into the open position, allowing fluid from the first inflatable elements to drain; and transitioning the rotatable ball into the closed position.

11. The method of claim 10, further comprising:

providing a perforated pipe coupled to the tool string and in fluid communication with the tool string bore when the rotatable ball is in the open position, the perforated pipe comprising at least one aperture to allow fluid to flow from the bore of the perforated pipe to the wellbore and a surrounding formation;

providing a second packer sub, the second packer sub coupled to the tool string below the perforated pipe and having a second inflatable element and a second packer inflation port, the second packer inflation port in fluid communication with the packer supply port of the valve sub housing;

filling the second inflatable element; and flowing fluid pumped through the tool bore through the at least one aperture of the perforated pipe into the wellbore between first and second packer subs.

12. The method of claim 10, wherein:

the control tube is transitioned into the closed position and the rotatable ball is transitioned into the open position by a downward movement of the tool string; and the control tube is transitioned into the open position and the rotatable ball is transitioned into the closed position by an upward movement of the tool string.

13. A valve assembly for use in a downhole tool as part of a tool string, the valve assembly comprising:

a housing, the housing being generally tubular having at least one output port;

a control tube, the control tube being generally tubular and aligned with the housing and having an upper and lower end, the upper end coupled to the tool string, and the lower end positioned within the bore of the housing, the control tube having a bore and at least one aperture through its side wall, the control tube having an open position in which the aperture provides fluid communication between the bore of the control tube and the output port, and a closed position in which the apertures are covered by the inner wall of the housing, the open and closed positions of the control tube selected by the upward or downward movement of the tool string the control tube bore being in fluid communication with the tool string bore;

a shift sleeve coupled to the lower end of the control tube having a hole adapted to accept an axle pin;

a rotatable ball adapted to rotate about the axle pin, the rotatable ball having at least one flow path through its body, the rotatable ball having an open position and a closed position selected by the upward or downward movement of the tool string, the open and closed positions of the rotatable ball being in opposition to the open and closed position of the control tube, thereby allowing or preventing fluid flow through the at least one flow path from the tool string bore and the bore of the control tube, the rotatable ball having a rotation pin extending from its outer surface; and a rotation pin sleeve coupled to the rotation pin adapted to rotate the ball from the closed position to the open position in response to a movement of the ball toward or away from the rotation pin sleeve.

14. The valve assembly of claim 13, further comprising:

an upper valve seat floatingly coupled to the shift sleeve to sealingly contact the rotatable ball in response to fluid pressure applied within the shift sleeve when the rotatable ball is in the closed position.

15. The valve assembly of claim 13, further comprising:

a lower valve seat positioned to sealingly contact the rotatable ball when the ball is in the open position, the lower valve seat having a bore in fluid communication with the at least one flow path when the rotatable ball is in the open position, the lower valve seat positioned spaced apart from the rotatable ball when the rotatable ball is in the closed position.

16. The valve assembly of claim 13, further comprising:

a spring positioned to bias the rotatable ball into the closed position and the control tube apertures into an open position.

17. The valve assembly of claim 13, wherein:

the rotatable ball is transitioned from the closed position to the open position and the control tube apertures are transitioned from the open position to the closed position by a downward movement of the tool string.

* * * * *